United States Patent [19]

Rones et al.

[11] 4,113,498

[45] Sep. 12, 1978

[54] CORROSION INHIBITOR FOR METAL SURFACES

[75] Inventors: Josef Rones; Siegfried Möller; Helmut Hoch, all of Frankfurt am Main, Fed. Rep. of Germany

[73] Assignee: Oxy Metal Industries Corporation, Warren, Mich.

[21] Appl. No.: 781,820

[22] Filed: Mar. 28, 1977

[30] Foreign Application Priority Data

Apr. 2, 1976 [DE] Fed. Rep. of Germany ..... 2614234

[51] Int. Cl.[2] ..... C09D 5/08

[52] U.S. Cl. ..... 106/14.13; 106/243; 252/110; 252/390; 252/394; 252/396

[58] Field of Search ..... 106/14, 243; 252/390, 252/394, 396, 110, 117, 546

[56] References Cited

U.S. PATENT DOCUMENTS

| | | | |
|---|---|---|---|
| 2,423,365 | 7/1947 | Blair | 260/404.8 |
| 2,483,253 | 9/1949 | Young et al. | 252/117 |
| 2,574,954 | 11/1951 | Bishop | 106/14 |
| 2,785,989 | 3/1957 | Davis et al. | 106/243 |

*Primary Examiner*—Lorenzo B. Hayes

*Attorney, Agent, or Firm*—Arthur E. Kluegel; Richard P. Mueller

[57] ABSTRACT

Disclosed is a corrosion inhibitor for metal surfaces. The surface is contacted with an alkaline aqueous solution containing a reaction product of an aliphatic carboxylic acid, a polyhydroxy carboxylic acid and an alkanol amine.

8 Claims, No Drawings

CORROSION INHIBITOR FOR METAL SURFACES

BACKGROUND OF THE INVENTION

The invention relates to an improved aqueous corrosion inhibitor for metal surfaces which, as a result of the use of certain substances, has a considerable corrosion-inhibiting effect and, at the same time, provides special advantages from the point of view of application techniques.

Treatment with aqueous solutions containing corrosion-inhibiting additives is usually carried out in order to prevent unwanted corrosion phenomena. More or less strongly alkaline solutions of this kind are used for temporary protection against corrosion, especially during production of metallic workpieces, during or after cleaning treatments, during machining, or during temporary storage prior to further processing stages. Known corrosion-inhibiting additives are, for example: alkali nitrites, alkali chromates or other organic compounds such as alkanolamines, more particularly triethanolamine, or alkali- or alkanolamine-soaps of fatty acids of intermediate chain length. Nitrites and chromates have the disadvantage that special measures must be taken to process the solutions before releasing them into the waste water. The corrosion protection achieved with alkanolamines or fatty-acid salts is frequently inadequate and more nitrite is therefore added to the solutions, but this once more leads to the operational disadvantage mentioned above.

There exists, therefore, a requirement for a corrosion inhibitor which has a considerable corrosion-inhibiting effect, which has many applications, and which is innocuous in waste water.

SUMMARY OF THE INVENTION

The aqueous treatment liquid according to the invention, for protecting metal surfaces against corrosion, is characterized in that it contains a reaction product of a mixture of: (a) at least one aliphatic carboxylic acid with 6 to 10 carbon atoms (b) at least one polyhydroxy carboxylic acid with (c) one or more alkanolamines. At least 1.3 moles of alkanolamine per mole of the acid combination $(a + b)$ being present.

DETAILED DESCRIPTION OF THE INVENTION

Aliphatic carboxylic acids useful in the invention contain from 6 to 10 carbon atoms. Polyhydroxy carboxylic acids useful contain from 4 to 10 carbon atoms. Preferred are gluconic or tartaric acid. Alkanolamines useful include the mono-, di-, and trialkanolamines of alkanol radicals of up to 4 carbon atoms.

The aliphatic carboxylic acid to polyhydroxycarboxylic acid weight ratio is preferably from 1 : 0.5 to 1 : 7. It is most preferable to select a ratio from 1 : 1 to 1 : 3.

Excellent results are obtained by using an aliphatic carboxylic acid having 8 carbon atoms, in conjunction with gluconic acid and/or tartaric acid. The alkanolamines used are preferably diethanolamine and/or monoethanolamine. Triethanolamine does not increase the corrosion-inhibiting action to the same extent.

When the corrosion inhibitor according to the invention is used, the pH value of the solution should be between 7.5 and 10. A value in this range is usually obtained by the addition of the reaction product. Preferably the concentration of the reaction product in the solution is between 0.5 and 5% by weight, and the pH value of the solution is between 8.0 and 9.5.

If it is desired to obtain an only weakly alkaline corrosion inhibitor in order to minimize attack on certain metals, such as aluminum, or in order to be able to release spent solutions into the waste water without neutralizing them, it is possible to lower the pH value by dissolving the reaction product in water and adding small quantities of organic or inorganic acids, without impairing the effectiveness of the corrosion inhibitor according to the invention. The following are examples of suitable acids: sulphuric acid, amidosulphonic acid, phosphoric acid, boric acid, adipic acid, maleic acid, phthalic acid, or benzoic acid.

The corrosion inhibitors according to the invention not only provide a considerable corrosion-inhibiting effect, as may be gathered from the following examples, but also have only a slight foaming tendency, which is a great advantage if they are to be sprayed. In addition to this they work well with hard water. No salt crystals remain on the metal surfaces after treatment. These corrosion inhibitors may be used for treating iron and steel, zinc, light alloys and non-ferrous metals such as aluminum and copper.

The reaction products according to the invention may be obtained from the acids and the alkonolamine at room temperature or at higher temperatures. Additional components which it is desired to add to the corrosion-inhibiting solution may also be admixed thereto during manufacture. The products obtained are usually clear, or slightly clouded even in hard water. In order to facilitate handling, it may be desirable to add more water, in order to obtain a concentrate having a water content of between 10 and 80 wt.%.

The aqueous solutions according to the invention may also contain other components, if this appears to be desirable. In many cases it is advisable to add surfactants in order to encourage a simultaneous cleaning and degreasing effect, and to ensure satisfactory wetting of the surfaces being treated with the corrosion inhibitor If surfactants are used, it is desirable to select nonionic low-foaming or foam-suppressing products based, for example, upon the alcohol, alkyl phenol, fatty-acid or fatty-amine addition-products of ethylene oxide or propylene oxide. The desired amount of the surfactants may be added directly to the treatment solution, but it is preferable to add them to the concentrate used in producing the solution. The amount desired depends, to some extent, upon the effectiveness of the surfactant used, but may be up to 20% of the anhydrous concentrate.

When light-alloys or non-ferrous metals are to be treated, it may be desired to use special inhibitors for the metals in question, for example alkali borates or condensed phosphates, for protecting aluminum against attack, or benzotriazole or derivatives thereof, for protecting non-ferrous metals against attack. However, any additions of such inhibitors should not exceed 10% of the anhydrous concentrate, since there is otherwise a danger of unwanted saltingout on the metal surfaces.

In certain cases it may also be desirable to add appropriate bactericides or fungicides, in order to protect the treatment solution from bacteria and fungi and after the absorption of fatty contaminants. Known agents for this purpose are, for example: phenol derivatives, compounds which split off formaldehyde, triazines and quarternary ammonium compounds. Such additives may be used in amounts of between 0.5 and 5 wt.% of the anhydrous concentrate.

Given below are examples of formulations for concentrates suitable for producing a corrosion-inhibiting composition according to the invention (in percentages by weight):

A)
- 10 caprylic acid
- 10 gluconic acid
- 25 diethanolamine
- } reaction product
- 10 nonionic surfactant ($C_{10-12}$—alcohol with 10 moles of ethylene oxide)
- 2.5 bactericide (splitting-off formaldehyde)
- 5 borax
- 37.5 water B)
- 5 caprylic acid
- 10 gluconic acid
- 5 tartaric acid
- 32 diethanolamine
- } reaction product
- 10 nonionic surfactant (nonylphenol with 8 moles of ethylene oxide)
- 1 benzotriazole
- 3 bactericide (quarternary ammonium compound)
- 34 water C)
- 12 caprylic acid
- 5 gluconic acid
- 7 tartaric acid
- 20 monoethanolamine
- 2 phosphoric acid
- } reaction product
- 5 pentasodium tripolyphosphate
- 6 nonionic surfactant (fatty acid with 12 moles of ethylene oxide)
- 3 bactericide (triazine base)
- 40 water The concentrate may be diluted with water to produce solutions containing between 0.5 and 5% by weight of the concentrate, depending upon requirements. A content of between 1 and 3% is usually sufficient.

The corrosion inhibiting effect of corrosion inhibitors according to the invention, and of individual components and other compositions, was checked in the comparison tests shown hereinafter. The tests were based upon German Industrial Standard 59 360, sheet 2 (draft June 1974) for the testing of aqueous lubricating-coolants (chip/filter-paper method), but the test samples were dissolved in 10° dH water. This method consists essentially in wetting 2 g of degreased grey cast-iron chips, on a circular filter, with 2 ml of the relevant test solution, whereupon the said filter is allowed to stand for 2 hours, in a covered Petri dish, at room temperature. The presence of corrosion spots on the filter paper is then evaluated.

In connection with the various tests, the following table first of all gives the composition and concentration of the concentrate used in producing the test solution and, where applicable, the molar ratio of carboxylic acid, or of a mixture of carboxylic and polyhydroxycarboxylic acid, to alkanolamine. The test solutions contained a 3% concentration of the concentrate. The pH values obtained are also given. The last column contains the results of the evaluation. It may be seen quite clearly that a substantially improved corrosion-inhibiting effect was obtained with the reaction products (Nos. 7-- 12) according to the invention.

| Test No. | Composition of concentrate | % by weight | Molar ratio | pH | Evaluation |
|---|---|---|---|---|---|
| 1 | monoethanolamine | 30 | — | 11 | 20–30 sharply defined corrosion spots |
| 2 | diethanolamine | 30 | — | 10.4 | about 80 corrosion spots |
| 3 | triethanolamine | 30 | — | 10 | entire surface covered with rust spots |
| 4 | caprylic acid | 20 | | | |
| | diethanolamine | 19 | 1 : 1.3 | 8.4 | as 3 |
| 5 | caprylic acid | 20 | | | |
| | diethanolamine | 29 | 1 : 2 | 8.8 | somewhat less than 4 |
| 6 | gluconic acid | 20 | | | |
| | kiethanolamine | 21.5 | 1 : 2 | 9.0 | entire surface covered with blurred rust spots |
| 7 | caprylic acid | 10 | | | |
| | gluconic acid | 10 | 1 : 1.3 | 8.6 | weak, blurred, brown discoloration |
| | diethanolamine | 15.2 | | | |
| 8 | caprylic acid | 10 | | | |
| | gluconic acid | 10 | 1 : 2 | 9.1 | no rust |
| | diethanolamine | 25 | | | |
| 9 | caprylic acid | 5 | | | |
| | gluconic acid | 15 | 1 : 2 | 9.1 | no rust |
| | diethanolamine | 23 | | | |
| 10 | caprylic acid | 5 | | | |
| | gluconic acid | 10 | 1 : 2 | 8.6 | no rust |
| | tartaric acid | 5 | | | |
| | diethanolamine | 32 | | | |
| 11 | capyrlic acid | 5 | | | |
| | gluconic acid | 10 | 1 : 2 | 8.2 | no rust |
| | tartaric acid | 5 | (excluding | | |
| | phosphoric acid | 2 | $H_3PO_4$) | | |
| | diethanolamine | 32 | | | |
| 12 | caprylic acid | 5 | | | |
| | gluconic acid | 10 | 1 : 2 | 9.4 | no rust |
| | tartaric acid | 5 | | | |
| | monoethanolamine | 19 | | | |

What is claimed is:

1. An aqueous composition which, when diluted with water, is suitable for inhibiting corrosion of metallic surfaces, comprising the reaction product of:
   (a) at least one aliphatic carboxylic acid having from 6 to 10 carbon atoms;
   (b) at least one polyhydroxycarboxylic acid having from 4 to 10 carbon atoms; and
   (c) an alkanolamine of an alkanol radical of up to 4 carbon atoms;

wherein the weight ratio of component a : b is from 1 : 0.5 to 1 : 7 and the molar ratio of c : a+b is at least 1.3 : 1.

2. The composition of claim 1 containing from 10 to 80 wt.% water.

3. The composition of claim 1 wherein the aliphatic carboxylic acid is caprylic acid.

4. The composition of claim 1 wherein the polyhydroxycarboxylic acid is selected from the group consisting of tartaric and gluconic acids.

5. The composition of claim 1 wherein the alkanolamine is selected from the group consisting of mono-and diethanol amine.

6. An aqueous corrosion inhibiting composition comprising the composition of claim 1 diluted to 0.5 to 5 wt.% in water.

7. The composition of claim 6 exhibiting a pH value of from 7.5 to 10.0.

8. A process for imparting corrosion resistance to a metal surface comprising contacting the surface with the composition of claim 7.

* * * * *